US006382095B1

(12) United States Patent
Mizutani

(10) Patent No.: US 6,382,095 B1
(45) Date of Patent: May 7, 2002

(54) STENCIL LEADING END MOUNTING DEVICE HAVING MOVABLE LINEAR PIVOT OF ROTARY STENCIL PRINTER

(75) Inventor: Tomohiro Mizutani, Inashiki-gun (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/707,935

(22) Filed: Nov. 8, 2000

(30) Foreign Application Priority Data

Nov. 11, 1999 (JP) ..... 11-321579

(51) Int. Cl.[7] ..... B41L 13/04

(52) U.S. Cl. ..... 101/116; 101/128.1; 101/415.1

(58) Field of Search ..... 101/116, 118, 101/127.1, 128.1, 129, 477, 415.1, 128.4

(56) References Cited

U.S. PATENT DOCUMENTS

| | | | | |
|---|---|---|---|---|
| 1,374,253 A | | 4/1921 | Tornberg | |
| 5,035,175 A | | 7/1991 | Takaita et al. | 101/116 |
| 5,503,075 A | | 4/1996 | Matsuo et al. | 101/477 |
| 5,575,204 A | | 11/1996 | Kawai et al. | 101/116 |
| 5,924,358 A | * | 7/1999 | Motoe et al. | 101/116 |
| 2001/0013286 A1 | * | 8/2001 | Watanabe | 101/118 |

FOREIGN PATENT DOCUMENTS

| | | |
|---|---|---|
| EP | 0 111 050 A1 | 6/1984 |
| EP | 0 596 746 A1 | 5/1994 |
| JP | A-59-96983 | 6/1984 |
| JP | A-59-96984 | 6/1984 |
| JP | A-59-143679 | 8/1984 |

* cited by examiner

*Primary Examiner*—Leslie J. Evanisko
(74) *Attorney, Agent, or Firm*—Oliff & Berridge, PLC

(57) ABSTRACT

A stencil leading end mounting device of a printing drum of a rotary stencil printer for clamping a stencil leading end between a stencil leading end supporting surface 70 of a base member 72 and a clamping surface 74 of a clamp member 76, the clamp member being biased at a drive portion 82 by a lever member 108 of an actuator to be tilted open about a linear pivot axis P, wherein the linear pivot axis P is defined by a contact point between a convex cam 115 and a bearing surface provided between the clamp member 76 and the based member 72, so as to move from a side of the clamping surface toward a side of the drive portion as the clamp member is more tilted.

6 Claims, 14 Drawing Sheets

STENCIL LEADING END MOUNTING DEVICE HAVING MOVABLE LINEAR PIVOT OF ROTARY STENCIL PRINTER

BACKGROUND OF THE INVENTION

1. Field of the Invention

The present invention relates to the field of rotary stencil printer, and more particularly to a device for mounting a leading end of a stencil to the printing drum of a rotary stencil printer.

2. Description of the Prior Art

A full automatic rotary stencil printer having a basic construction such as shown in FIG. 1 is already known. In FIG. 1, 10 is a printing drum which is driven to rotate anti-clockwise as shown by an arrow by printing drum driving means not shown in the figure when a stencil is mounted to the printing drum, also when the printing is carried out, and also when the used stencil is exhausted from the printing drum.

A stencil leading end mounting device generally designated by 12 in which the present invention is incorporated is provided at a part of the printing drum 10. 14 is a roll of a band stencil sheet providing a stencil sheet supply source. The stencil sheet drawn out from the roll 14 is conducted through a guide passage 16, between a thermal head 18 and a platen roller 20, the thermal head 18 perforating the stencil sheet to form a stencil according to image data based upon an electric image data signal supplied thereto from image data processing means not shown in the figure, a cutter 22 in an open state, a movable passage 24 adapted to be positioned horizontal for receiving the leading end of the stencil and thereafter to break down at a break point 25 to be inclined as shown by phantom lines in the figure for giving an allowance in the feed of the stencil, and between stencil feed rollers 26 and 28 which feed the stencil so that the leading end thereof proceeds into the stencil leading end mounting device 12 under a controlled feed rate through a passage 30 and a movable stencil guide lip 32.

After the leading end of the stencil has been fastened by the stencil leading end mounting device 12, the succeeding part of the stencil perforated by a further operation of the thermal head 18 is first slackened for each predetermined length corresponding to a stroke of swing of the movable passage 24 about the break point 25, while the printing drum 10 is intermittently driven in synchronization therewith to take up each allowance provided by the slackened stencil so that the stencil is gradually mounted around the printing drum 10.

The stencil feed rollers 26 and 28 are put into idling, after the leading end of the stencil has been fastened by the stencil leading end mounting device 12. When a predetermined amount of stencil has been fed, the cutter 22 is operated to cut out a sheet of stencil from the continuous band stencil sheet.

When a sheet of perforated stencil has been mounted around the printing drum 10, the printer proceeds to a printing process, wherein print sheets are successively supplied from a print sheet supply tray not shown in the figure and are fed through between print sheet feed rollers 34 and 36 to a nipping region 40 between the printing drum 10 and a press roller 38.

A squeeze roller 42 is provided in the printing drum 10 to oppose the nipping region and to be driven anti-clockwise as shown by the arrow in the figure in synchronization with the rotation of the printing drum 10. A doctor rod 44 is provided adjacent the squeeze roller 42 to define a groove 46 to hold an ink deposit 52 formed by ink 50 supplied from an ink distributor 48.

An agitation rod 54 is provided in the groove 46 at a central position thereof to provide a core of the ink deposit 52, so that the ink deposit 52 forms a rotating mass of ink rotating clockwise around the agitation rod 54 when the squeeze roller 42 rotates anti-clockwise as viewed in the figure, with a part of the rotating mass of ink being successively drawn out therefrom in the form of an ink layer 56 carried on the squeeze roller 42 to be supplied to the inner circumferential surface of the printing drum 10, this ink being further passed through the perforations of the stencil mounted around the printing drum 10 and transferred onto the print sheet fed through the nipping region 40 to form a stencil print image on the print sheet.

The print sheet thus applied with the stencil printing tends to move along the outer circumferential surface of the printing drum 10 due the adhesiveness of the ink, but the print sheet is removed from the outer circumferential surface of the printing drum as peeled off therefrom by a print sheet removal claw 58 and is transferred by a belt conveyer type print sheet discharge means 60 toward a printed sheet receiving tray not shown in the figure.

When the stencil mounted around the printing drum 10 is to be exhausted, the stencil leading end mounting device 12 is operated in a manner described in detail hereinbelow, so that the leading end of the stencil is released from the clamping by stencil leading end mounting device 12 and is brought into a state freely placed thereon.

Then the printing drum 10 is rotated in the direction shown by the arrow for the exhausting of the stencil such that the leading end of the stencil is scooped up by a stencil removal claw 62 when it traverses the tip end of the claw and is then bitten into between belt conveyers 64 and 66 of a stencil exhausting means, each of which-is moving in the direction shown by arrows, thus the stencil being successively peeled off from the printing drum 10 as the printing drum 10 is further rotated, to be finally exhausted into a stencil exhaust box positioned on the left side of the belt conveyers 64 and 66 though not shown in the figure.

A belt conveyer 68 operates to guide the leading end of the stencil toward a nipping region between the belt conveyers 64 and 66 if the leading end of the stencil would divert away from the nipping region.

With respect to a rotary stencil printer having such a known basic construction, in U.S. Pat. No. 5,575,204 owned by the same assignee as the present application, there has been proposed an improved construction of the stencil leading end mounting device 12 such as shown in FIGS. 2 and 3*a*–3*h*.

In these figures, the stencil leading end mounting device 12 comprises a base member 72 having a band surface 70 working as a stencil leading end supporting surface, the band surface extending along a portion of the cylindrical outer surface of the printing drum 10 along a generatrix of the printing drum in parallel with the central axis thereof and incorporating a magnet piece (desirably a rubber magnet piece) planted therein, and a clamp member 76 having a clamping surface 74 and movable between a closed position (the position shown in FIG. 2 and FIG. 3*a*) where the clamping surface is laid over the stencil leading end supporting surface 70 and an open position (the position shown in FIG. 3*b*) where the clamping surface is removed from the stencil leading end supporting surface 70.

The clamp member 76 is a plate element of a magnetic material having an elongated rectangular shape extending in parallel with the central axis of the printing drum, and is pivotably supported at longitudinally opposite end portions by a pair of bearing means 78 mounted to the base member 72, so as to be movable between the above-mentioned closed and open positions. The clamp member 76 is constantly magnetically attracted toward the closed position by the above-mentioned magnet piece. The clamp member 76 has a plurality of ribs 80 spaced along the upper surface of the plate element forming the principal portion of the clamp member. Further, the plate element forming the principal portion of the clamp member 76 includes a lever portion 82 at one longitudinal end thereof.

The stencil leading end mounting device 12 further comprises a snap-up member 88 which, in the shown construction, is formed of a rod element 84 and a pair of arm elements 86 firmly mounted at opposite ends of the rod element. The snap-up member is movable such that the part formed by the rod element 84 moves between a first position close to the inlet edge 90 of the stencil leading end supporting surface 70 (the position shown in FIG. 3*a*) and a second position close to the inlet edge 92 of the clamping surface 74 of the clamp member 76 positioned at the open position thereof (the position shown in FIG. 3*e*) in relation to supply/exhaust of the stencil.

The pair of arm elements 86 are pivotably supported by a pair of bearing means 94 mounted to the base member 72 so that the rod element 84 is movable between the first and second positions. The pair of arm elements 86 are each a plate element made of a magnetic material and are constantly magnetically attracted by the above-mentioned magnet piece just as the clamp member 76 is, such that when the rod element 84 is at the first position, the pair of arm elements 86 are seated on the stencil leading end supporting surface 70. One of the pair of arm elements 86 includes a lever portion 96 extending to the opposite side of the bearing means 94 relative to the rod element 84.

Thus the clamp member 76 is biased around the bearing means 78 toward the closed position by the magnetic attraction of the above-mentioned magnet piece, and when the clamp member 76 is at the closed position, the clamping surface 74 of the clamp member is pressed against the stencil leading end supporting surface 70 under a predetermined pressing force. The snap-up member 88 formed of the rod element 84 and the pair of the arm elements 86 is also biased about the bearing means 94 toward the first position by the magnetic attraction force of the magnet piece.

Further, there are provided means for pivoting the clamp member 76 biased to the closed position toward the open position against the biasing force of the magnet piece and means for pivoting the snap-up member 88 from the first position toward the second position against the biasing force of the magnet piece. These means are actuating means comprising a pulse, motor 98 having a shaft 100, first and second cams 102 and 104 supported by the shaft 100, first and second lever members 108 and 110 adapted be pivoted about a pivot shaft 106 by those cams, and tension coil springs 112 and 114 biasing those lever members about the pivot shaft 106.

The cam 102 has first cam portion 102*a* and a second cam portion 102*b* displaced from one another for 180° around the central axis of the pulse motor shaft 100 to be opposite to one another while the cam 104 has a single cam portion 104*a* angularly shifted relative to the cam portions 102*a* and 102*b* as shown in FIG. 2. The pulse motor shaft 100 rotates clockwise when viewed in FIG. 2 from front and left side therein.

The stencil leading end mounting device 12 of the above-mentioned construction operates as follows:

First, at the starting of the operation of the stencil printer where no leading end of the stencil is yet mounted to the stencil leading end mounting device 12, the respective portions of the device are in the state depicted in FIG. 2 and FIG. 3*a*. In this connection, however, it is to be noted that in this kind of rotary stencil printer, except when a new machine is going to be first started, it is the general practice that, when the stencil printing by a sheet of stencil has been completed, the used stencil is left in the mounted condition until the next printing by the next sheet of stencil is started, to avoid the drying up of the ink contained in the circumferential wall of the printing drum while the stencil printer is at rest.

Therefore, generally, prior to starting of the printing operation by a new stencil, prior to the perforation of the new stencil or in parallel thereto, the process of exhausting the used stencil from the printing drum is carried out. Therefore, the condition shown in FIG. 2 and FIG. 3*a* as the starting condition is the condition where such a prior stencil exhausting process has been finished. In this state, neither of the cams 102 and 104 are pressing the lever members 108 and 110 downward, so that the lever members 108 and 110 are turned up around the pivot shaft 106 to the respective highest position by the action of the springs 112 and 114, so that the lever portion 82 of the clamp member 76 and the lever portion 96 of the snap-up member 88 are both released from the pressing action by the lever members 108 and 110, respectively, so that the clamp member 76 is at the closed position with the clamping surface 74 being laid over the stencil leading end supporting surface 70 of the base member 72, while the snap-up member 88 is at the first position with the rod element 84 being positioned close to the leading edge 90 of the stencil leading end supporting surface 70.

When there comes a time that the leading end of a stencil is to be mounted to the stencil leading end mounting device 12, the respective portions of the device take the state shown in FIG. 3*b*, so that the lever member 108 is turned around the pivot shaft 106 downward by the cam portion 102*a* of the cam 102 against the action of the spring 112, so that the tip end of the lever member 108 pushes the lever portion 82 of the clamp member 76 against the magnetic attraction force acting thereto from the magnet piece, so that the clamp member 76 is turned around the pair of bearings 78 as shown in FIG. 3*b*, such that the clamping surface 74 makes such a space against the stencil leading end supporting surface 70 of the base member 72 suitable for taking in the leading end 116 of the stencil approaching thereto from the right side in the figure.

When the pulse motor 98 turns its shaft 100 further, the respective portions of the device take the state shown in FIG. 3*c*, wherein the clamp member 76 is positioned at the closed position with the clamp member 76 laid over the stencil leading end supporting surface 70 of the base member 72. Therefore, the leading end 116 of the stencil having proceeded between the stencil leading end supporting surface 70 and the clamping surface 74 is clamped therebetween, and held in the clamped state under the magnetic attraction force of the magnet piece acting to the clamp member 76.

Thereafter, as already described with reference to FIG. 1, the printing drum 10 is rotated in the direction shown by the arrow, with a progress of the perforation of the stencil by the thermal head 18, so that the stencil is gradually intermittently mounted around the printing drum 10 starting from the leading end thereof mounted to the stencil leading end mounting device 12, until such a perforation/mounting transfer of the stencil reaches a predetermined length, and then the cutter 22 is operated to cut off a piece of stencil from the band sheet of stencil, thus finishing the mounting process of the stencil around the printing drum 10. Then, the printing process is carried out as described above.

After a required printing operation had been finished, and after the used stencil has been left as mounted around the printing drum, when the used stencil is to be removed from the printing drum 10 prior to the next printing by a new stencil, the pulse motor 98 is further rotated so that the cam portion 102*b* of the cam 102 pushes the lever member 108 downward so that the clamp member 76 is turned up from the closed position shown in FIG. 3*c* toward the open position against the magnetic attraction force of the magnet piece to take the state shown in FIG. 3*d,* whereby the leading end 116 of the stencil is released as shown in FIG. 3*d* from the prior condition clamped between the stencil leading end supporting surface 70 and the clamping surface 74, although the leading end of the stencil is still laid below the clamp member 76 so that it can not yet move beyond the clamp member toward the stencil exhausting means.

Then, the pulse motor 98 is further rotated so that the snap-up member 88 is moved from the first position close to the inlet edge 90 of the stencil leading end supporting surface 70 to the second position close to the inlet edge 92 of the clamping surface 74 of the clamp member 76 still maintained at the open position by the cam 102 as shown in FIG. 3*e.* By this action of the snap-up member 88, the leading end 116 of the stencil is brought to the state floated up from the stencil leading end supporting surface 70 as shown FIG. 3*e.*

Then, the pulse motor 98 is further rotated so that the lever member 108 is lifted as released from the pressing action of the cam 102, and in accordance therewith the clamp member 76 is returned to the closed position as shown in FIG. 3*f,* while the snap-up member 88 is still maintained at the second position. Therefore, the leading end 116 of the stencil moves from the lower side of the clamping surface 74 to the other side of the clamp member 76 (upper side in the figure) by traversing the inlet edge 92 of the clamp member 74 as shown in FIG. 3*f.*

Thereafter, the pulse motor 98 further rotates so far that the clamp member 76 and the snap-up member 88 are returned to the respective closed and first positions as shown in FIG. 3*g,* wherein, however, the leading end 116 of the stencil is released on the upper side of the clamp member 76.

When the printing drum is further rotated, the tip end of the stencil removal claw 62 gets into under the leading end 116 of the stencil to scoop it up as shown in FIG. 3*h,* and then, in the manner described with reference to FIG. 1, the stencil is bitten into between the belt conveyers 64 and 66 of the stencil exhausting means starting from the leading end thereof, so that the stencil is gradually removed from the circumferential surface of the printing drum according to the rotation thereof, and the removed stencil is finally transferred into the stencil exhaust box provided on the left side in the figure but not shown in the figure.

As well known in the art, the magnetic attraction force is reversely proportional to the square of the inter distance. Therefore, in the above-mentioned prior art construction of the stencil leading end mounting device, when the clamp member 76 is opened from the closed position laid over the stencil leading end supporting surface 70 toward the open position, the clamp member laid over the stencil leading end supporting surface 70 incorporating the magnet piece is first attracted by the magnetic attraction force at such a relatively high intensity as needed to definitely fasten the stencil leading end to the stencil leading end supporting surface 70 available by the contact approach of the clamp member 76 to the magnet piece, and therefore, the pressing force applied by the first lever member 108 to the lever portion 82 of the clamp member 76 needs to be substantially high at the beginning to overcome such a high magnetic attraction force applied thereto by the magnet piece, but such a high resistance decreases quite rapidly as the clamp member departs from the stencil leading end supporting surface, or the magnet piece.

Therefore, under such a circumstance, a substantial elastic energy is stored in the clamp member and the related clamp member driving construction in the initial stage of opening the clamp member from the closed position until the moment at which the clamp surface 74 of the clamp member 76 detaches from the stencil leading end supporting surface 70, such a stored elastic energy being instantly released after the detachment of the clamp surface 74 from the stencil leading end supporting surface 70 as the magnetic attraction force rapidly lowers according to the inverse proportion of the square of the distance of removal, thereby causing vibrations of the clamp member and the related clamp member driving construction by the released elastic force being overlapped to the driving force by the lever member 108.

SUMMARY OF THE INVENTION

In view of the above-mentioned problem, it is a principal object of the present invention to provide an improved stencil leading end mounting device of a rotary stencil printer in which the above-mentioned problem is effectively avoided.

According to the present invention, the above-mentioned object is accomplished by a stencil leading end mounting device of a printing drum of a rotary stencil printer, comprising:

a base member having a stencil leading end supporting surface incorporating a magnet therein, the stencil leading end mounting surface extending along a generatrix of the printing drum for receiving thereon a leading end of a stencil to be mounted around the printing drum;

a clamp member having a clamp portion formed with a stencil clamping surface and a drive portion opposite to the clamp portion, the clamp member being supported on the base member to be tiltable relative to the stencil leading end supporting surface between a closed position in which the clamp portion is laid over the stencil supporting surface so as to clamp the stencil leading end between the stencil supporting surface and the stencil clamping surface under a magnetic attraction of the clamp portion by the magnet toward the stencil supporting surface and an open position in which the stencil clamping surface is inclined apart relative to the stencil leading end supporting surface so as to expose an inter space therebetween for entrance thereto and removal therefrom of the stencil leading end;

pivot means for providing a linear pivot axis between the base member and the clamp member for the clamp member to tilt thereabout between the closed position and the open position with the linear pivot axis being positioned between the clamp portion and the drive portion of the clamp member; and actuation means for selectively biasing the drive portion of the clamp member for tilting the clamp member from the closed position to the open position, wherein the pivot means provide the linear pivot axis so as to move relative to the clamp member from a side of the clamp portion to a side of the drive portion according to a progress of tilting of the clamp member away from the closed position toward the open position.

According to the above-mentioned construction of the stencil leading end mounting device, when the clamp member is opened from the closed position toward the open position, at the initial stage of the clamp member being just removed from the stencil leading end supporting surface by the drive portion thereof being biased by the actuation means, since the linear pivot axis is positioned at the utmost clamp portion side while remotest from the drive portion side to provide a largest force magnifying lever ratio for the actuation means to tilt the clamp member by biasing the drive portion, the clamp member is softly driven by a relatively strong and slowly acting force, and when the clamp member is moved more from the closed position toward the open position, the linear pivot axis shifts more from the clamp portion side toward the drive portion side of the clamp member, so that the force magnifying lever ratio is gradually decreased so as to meet with the decrease of need for the driving, while conversely increasing a displacement magnifying lever ratio for more widely opening the inter space between the stencil leading end supporting surface and the stencil clamping surface of the clamp member relative to the biasing amount of the drive portion by the actuation means.

By such an arrangement, the clamp member is softly detached from the stencil leading end supporting surface as driven by a relatively strong and slowly acting force in the beginning stage of opening from the closed position toward the open position, then being driven by a rapidly decreasing biasing drive force to balance with the released elastic energy, while in the final stage of the opening the clamp member is relatively widely opened for a better convenience of an infallible clamping of the stencil leading end.

In the above-mentioned stencil leading end mounting device the clamp member may have either a pair of bearing surfaces or a pair of convex cams along opposite end portions of the stencil clamping surface thereof corresponding to opposite axial ends of the printing drum, while the base member comprises either a pair of convex cams supporting the pair of bearing surfaces or a pair of bearing surfaces supporting the pair of convex cam surfaces, such that each cam surface of the pair of convex cams contacts with each of the pair of bearing surfaces at a point which moves along the cam surface from the clamp portion side to the drive portion side according to the progress of tilting of the clamp member away from the closed position.

In such a construction, the pivot means may further comprise means for restricting a slipping of the bearing surface relative to the cam surface therealong.

Such slip restriction means may comprise a pair of guide grooves provided on either side of the base member and the clamp member adjacent the pair of cams to extend substantially perpendicularly relative to a direction of extension of the cam surface and a pair of projections provided on the other side of the base member and the clamp member so as to engage in the guide grooves.

In this case, the pair of guide grooves may each be arcuate to follow a contour of movement of each of the pins relative to each of the guide grooves due to a rolling of the clamp member on the cams.

Alternatively, the slip restriction means may comprise a plurality of projections formed along each of either the cam surfaces or the bearing surfaces, and a corresponding plurality of openings formed in each of wither the bearing surfaces of the clamp member or the cam surfaces so as to engage with the projections according to a rolling of the bearing surfaces on the cam surfaces.

BRIEF DESCRIPTION OF THE DRAWING

In the accompanying drawing.

DESCRIPTION OF THE PREFERRED EMBODIMENTS

Figure 1:
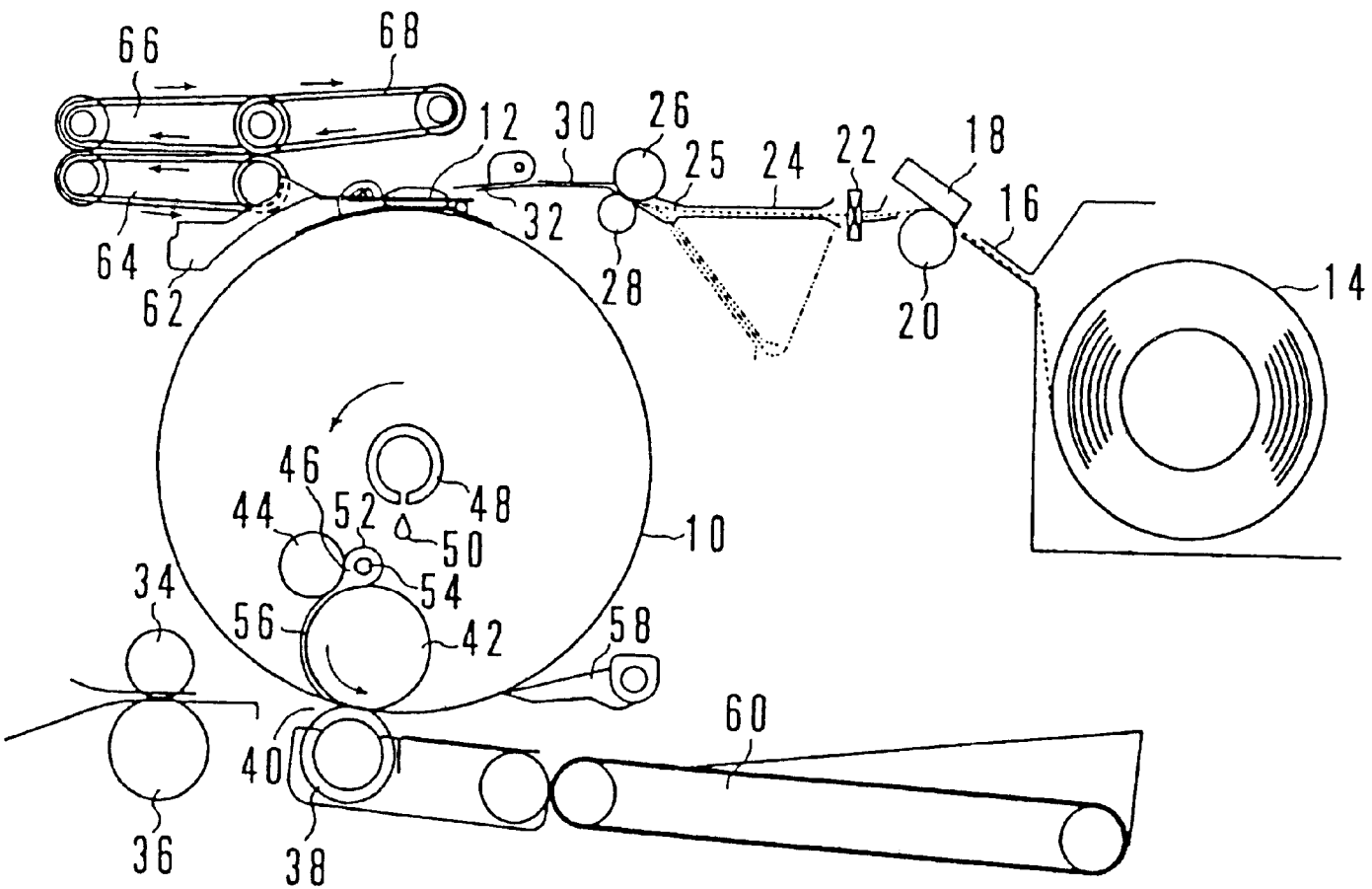
FIG. 1 PRIOR ART
FIG. 1 is a diagrammatic view depicting essential portions of the basic construction of a prior art full automatic rotary stencil printer for the purpose of illustrating the position at which the stencil leading end mounting device according to the present invention is positioned in the full automatic rotary stencil printer.
Figure 2:
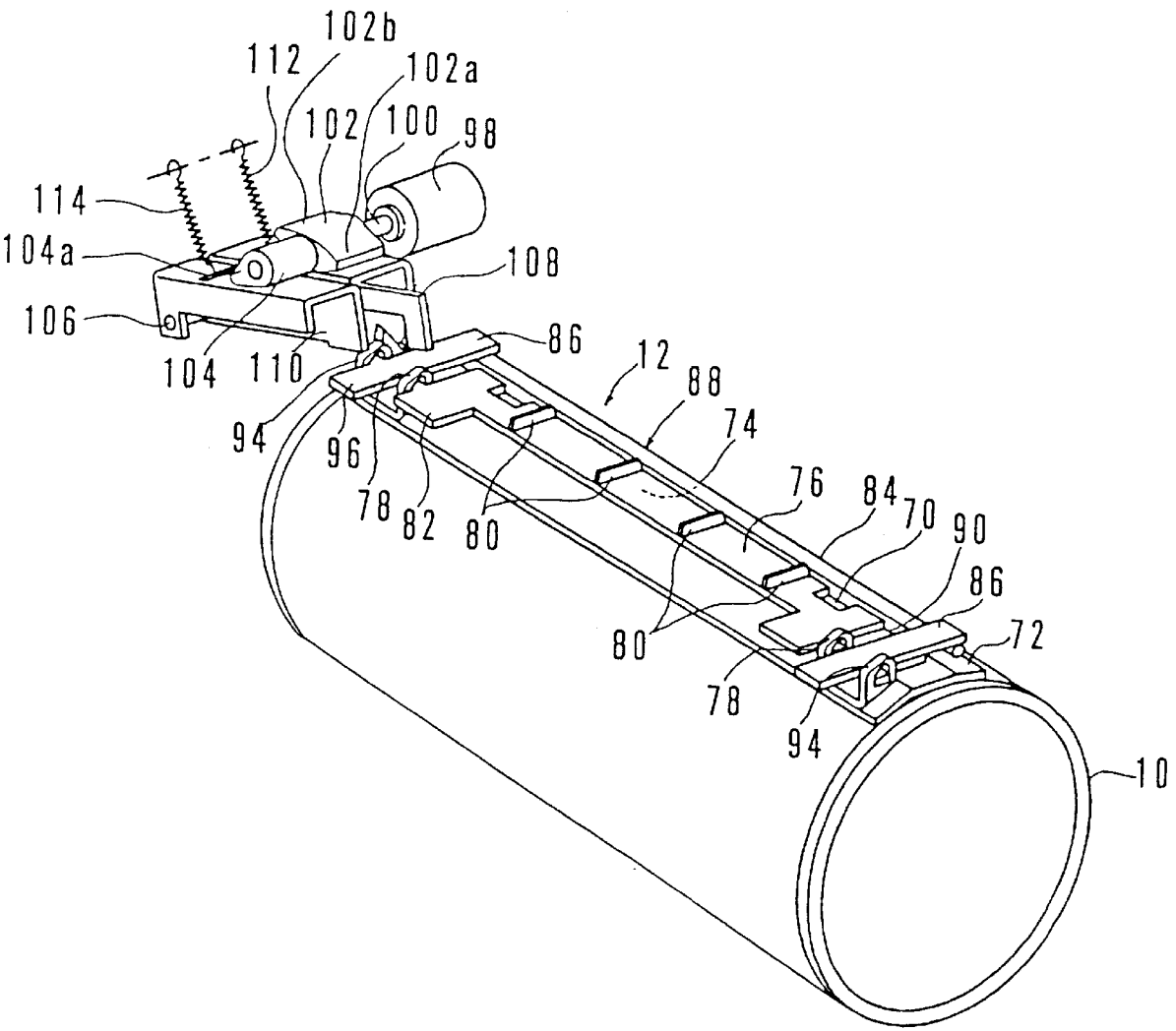
FIG. 2 PRIOR ART
FIG. 2 is a perspective view showing essential portions of a prior art printing drum incorporating a type of stencil leading end mounting device in which the present invention is incorporated.
Figure 3A:
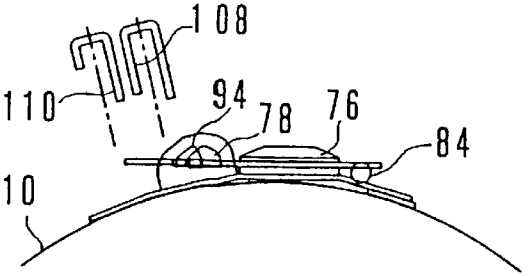
FIG. 3a PRIOR ART
FIGS. 3*a,* 3*b,* 3*c,* 3*d,* 3*e,* 3*f,* 3*g* and 3*h* are diagrammatic side views of the prior art stencil leading end mounting device shown in FIG. 2, showing a series of operating conditions thereof.
Figure 3B:
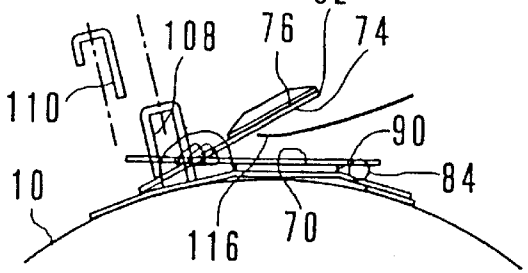
FIG. 3b PRIOR ART
Figure 3C:
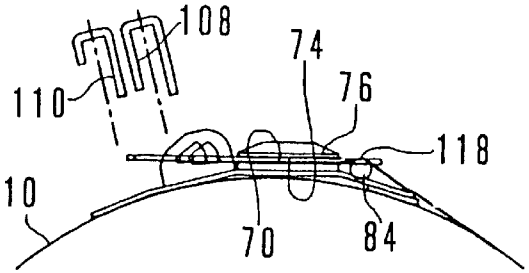
FIG. 3c PRIOR ART
Figure 3F:
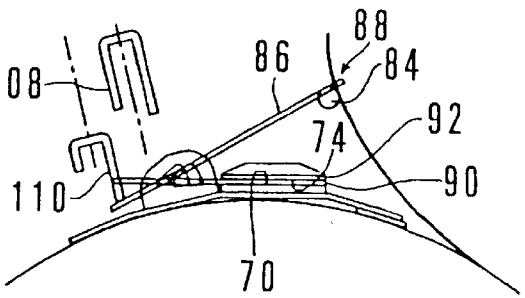
FIG. 3f PRIOR ART
Figure 3E:
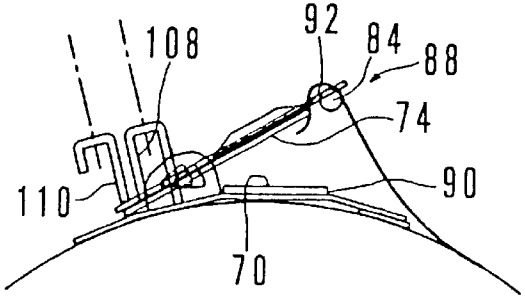
FIG. 3e PRIOR ART
Figure 3D:
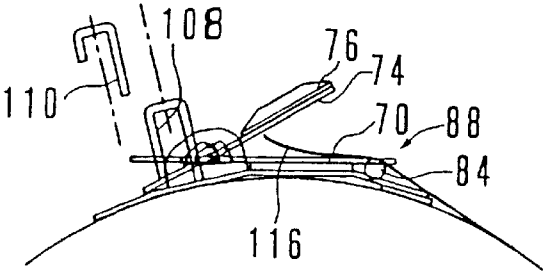
FIG. 3d PRIOR ART
Figure 3H:
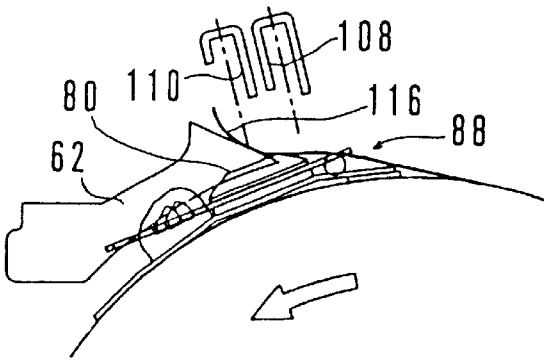
FIG. 3h PRIOR ART
Figure 3G:
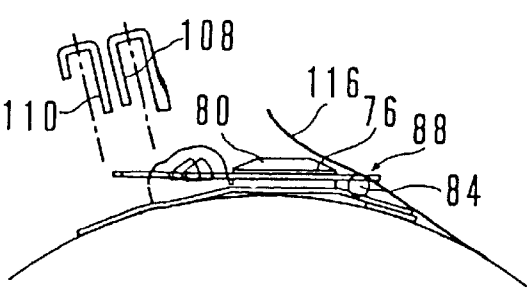
FIG. 3g PRIOR ART
Figure 4:
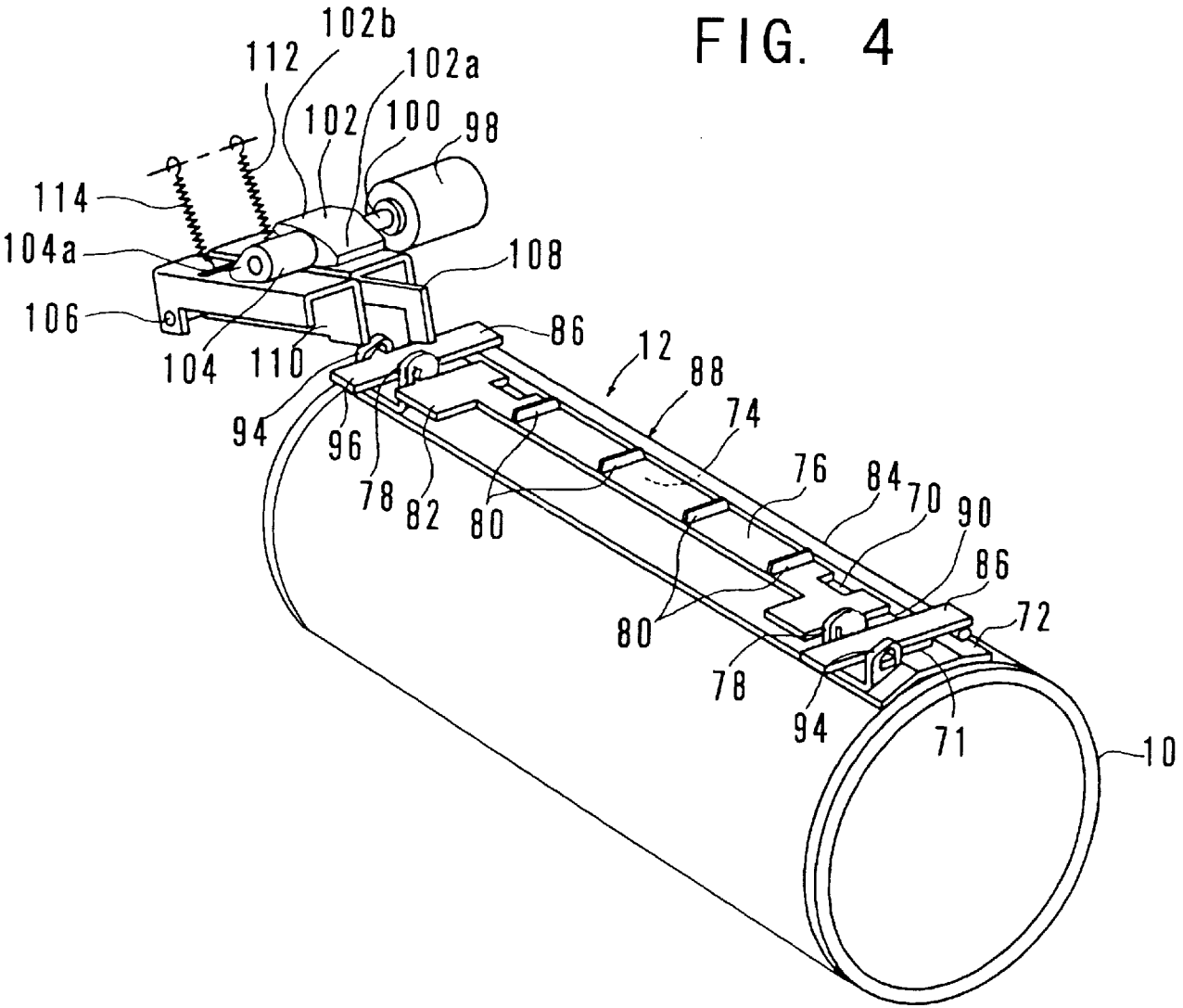
FIGS. 4–9 are perspective views similar to FIG. 2, showing essential portions of a printing drum incorporating an embodiment of the stencil leading end mounting device according to the present invention, wherein the operating conditions of the clamp member and the snap-up member shown in FIGS. 4–9 correspond to those shown in FIGS. 3*a*–3*f,* respectively.
Figure 5:
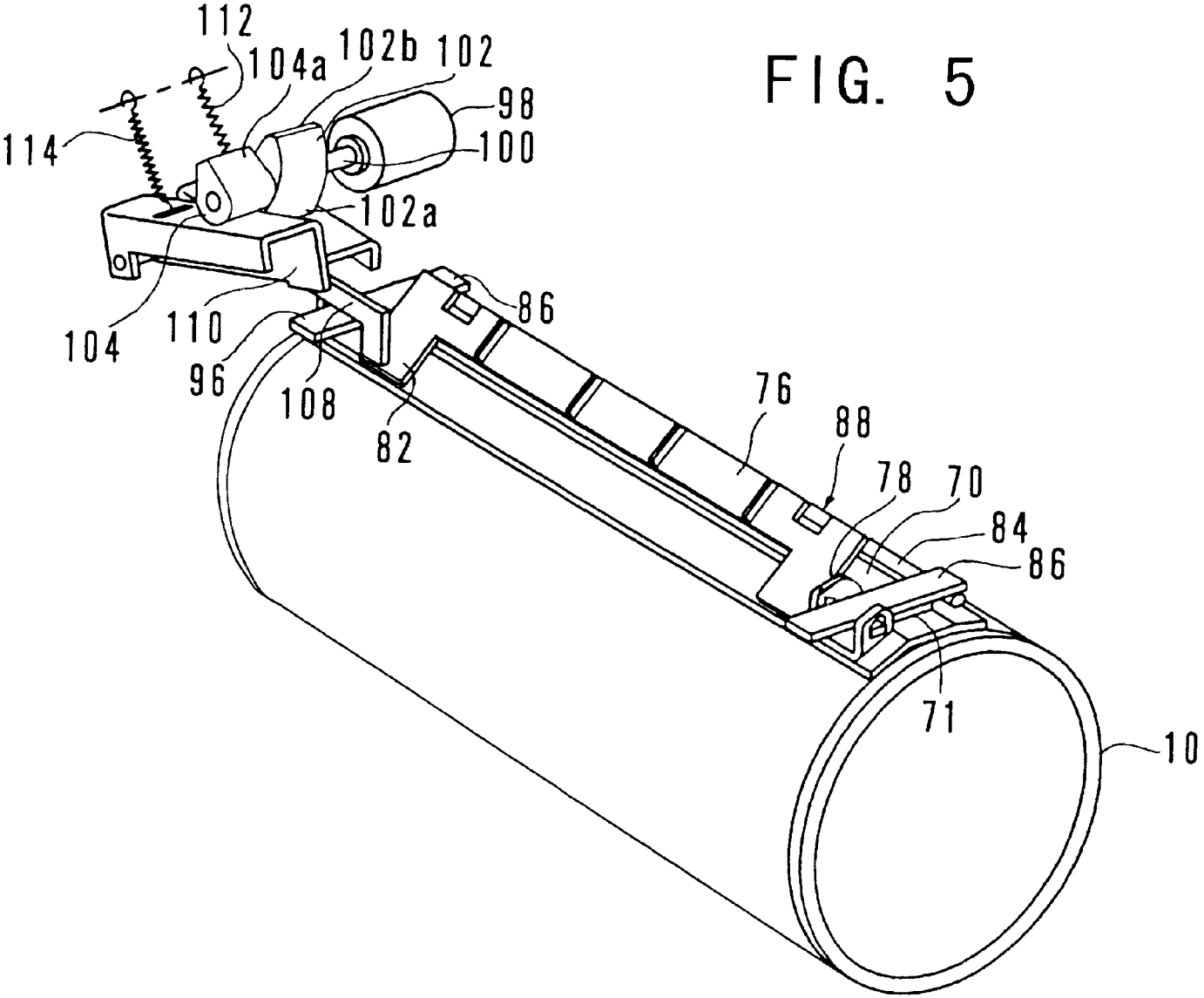
Figure 6:
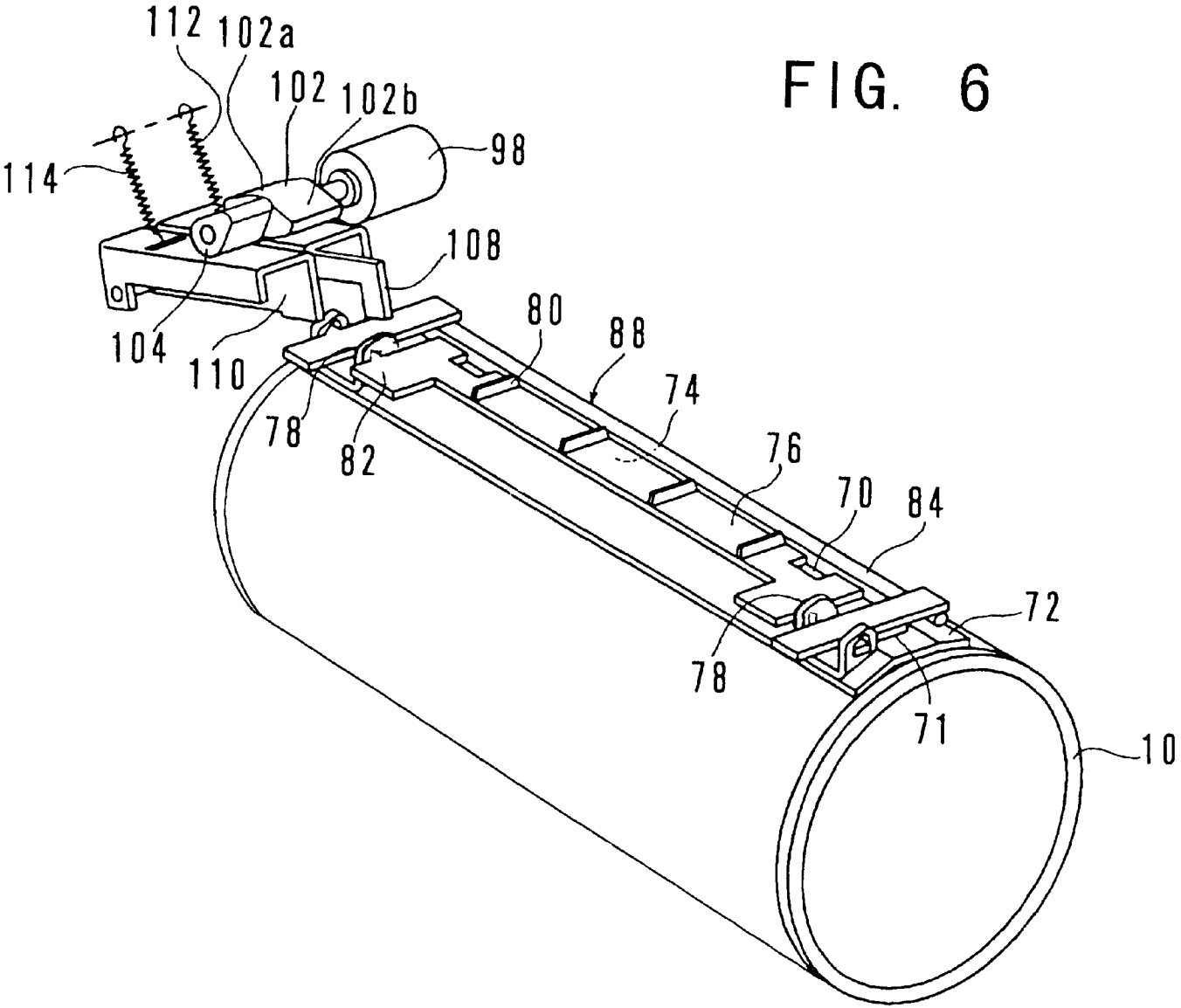
Figure 7:
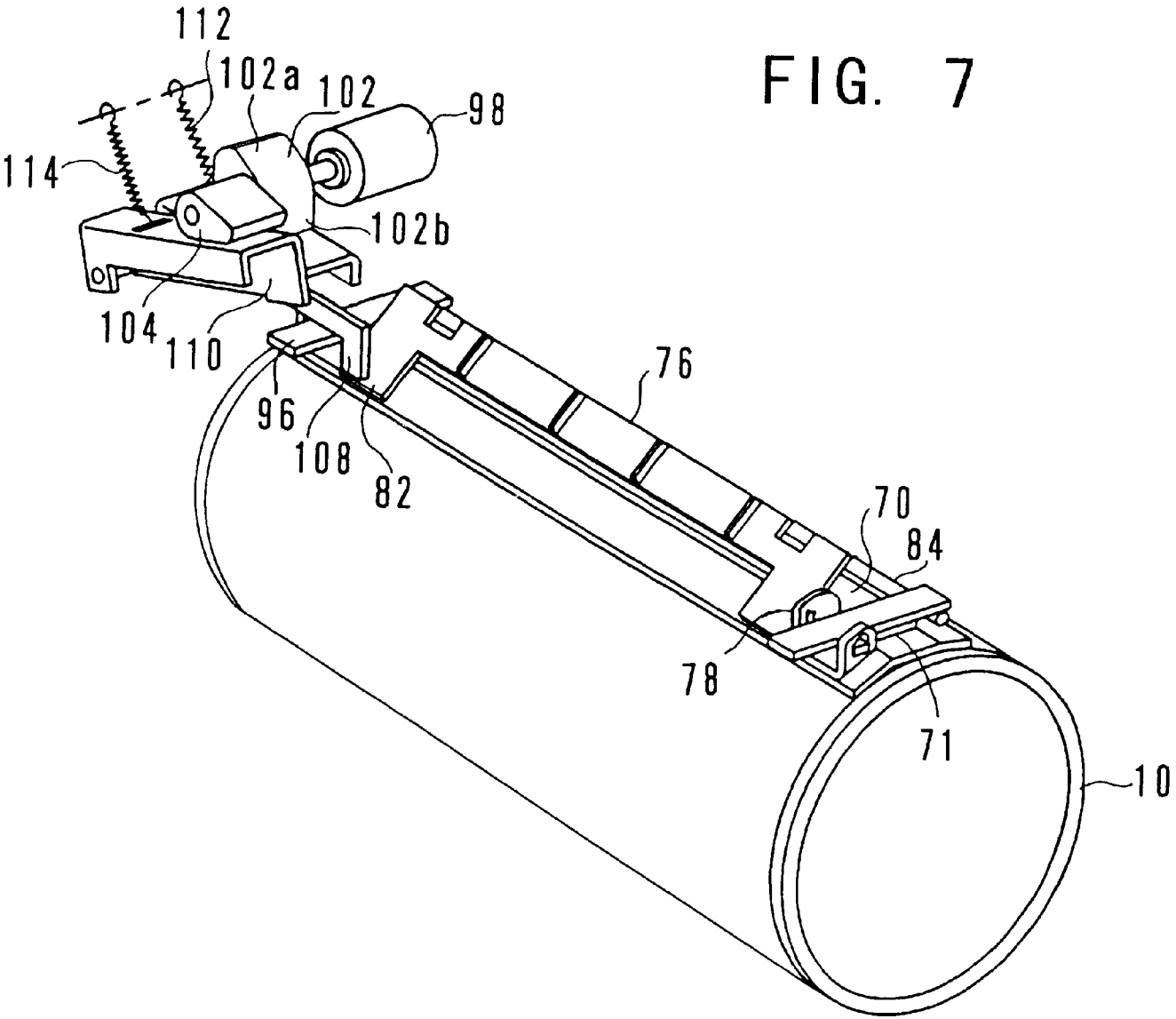
Figure 8:
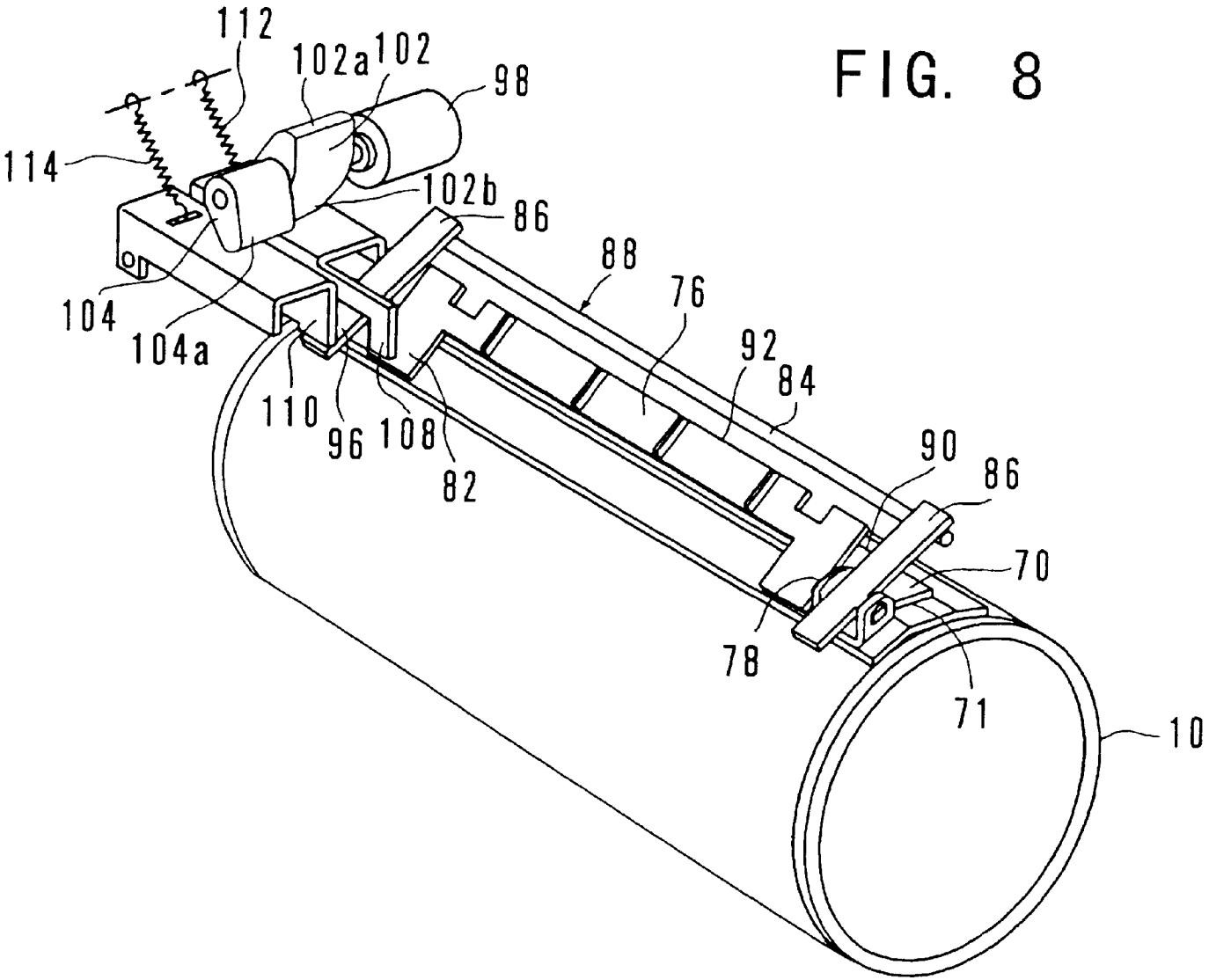
Figure 9:
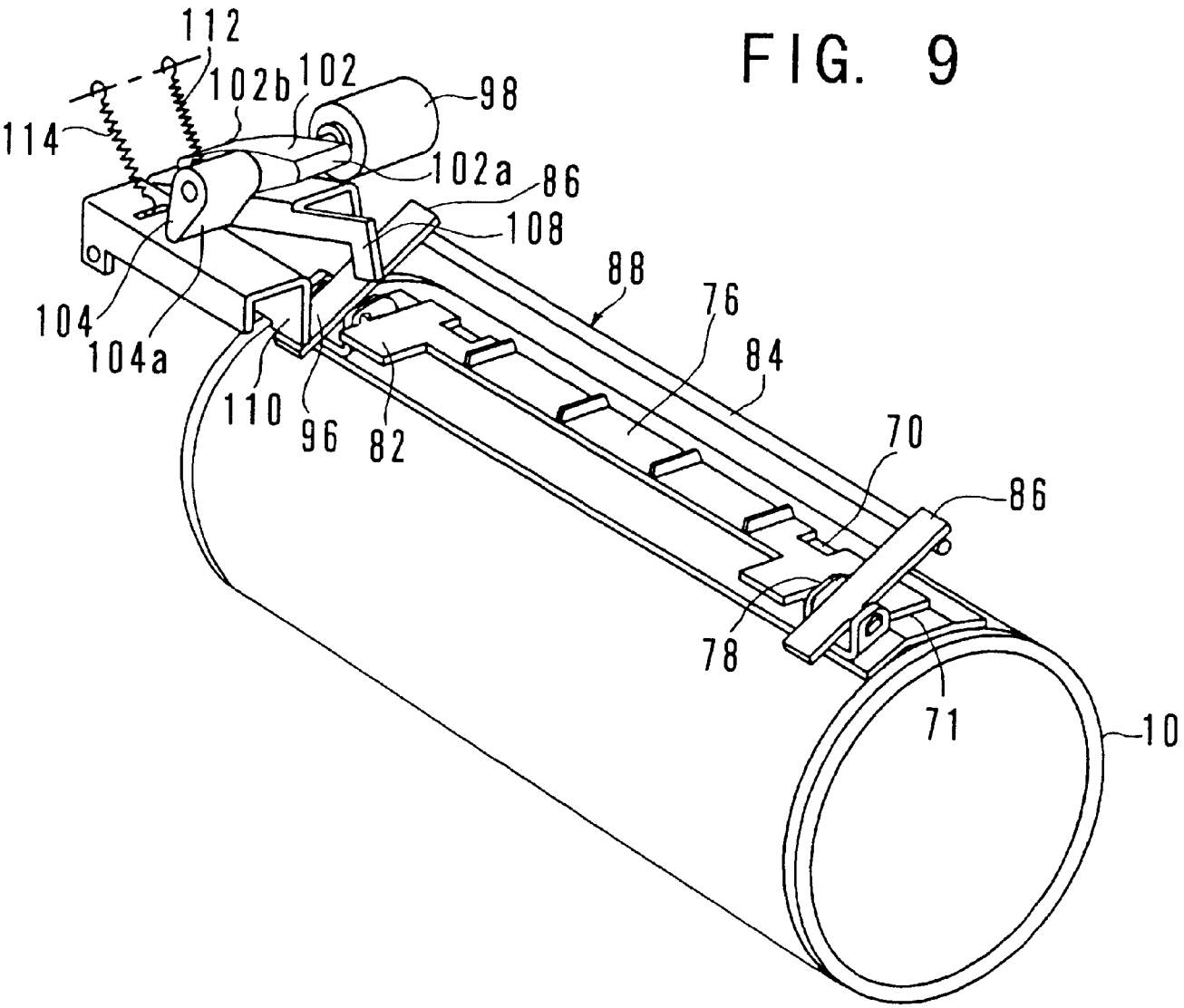

In the following the present invention will be described in more detail with respect to some preferred embodiments with reference to FIGS. 4–17.

The stencil leading end mounting device according to the present invention operates generally in the same manner as the prior art stencil leading end mounting device shown and explained with reference to FIGS. 2 and 3*a*–3*h*. Therefore, in FIGS. 4–17, the portions corresponding to those shown in FIGS. 2 and 3*a*–3*h* are designated by the same reference numerals as in FIGS. 2 and 3*a*–3*h,* and further repetitive descriptions of those corresponding portions in the embodiments of the present invention will be omitted for the brevity of the specification.

For the general understanding of the present invention, the operating conditions of the embodiment of the present invention shown in FIGS. 4–9 correspond to those shown in FIGS. 3*a*–3*f* of the prior art, respectively. However, the pivotably supporting construction of the clamp member 76 is substantially different in the present invention.

According to the present invention, referring FIGS. 4–13, particularly FIGS. 10–13, the clamp member 76 includes a clamp portion principally made of elongated rectangular magnetic plate members 76A and 76B fixed one over the other by an adhesive or the like and extending along a generatrix of the printing drum, and a pair of bearing portions made of smaller elongated rectangular plate members 76C extending perpendicularly to the elongation of the plate member 76B and connected to opposite narrower ends thereof, the bearing portions each presenting a bearing surface 76C1 facing downward toward the base member 72.

Figure 11:
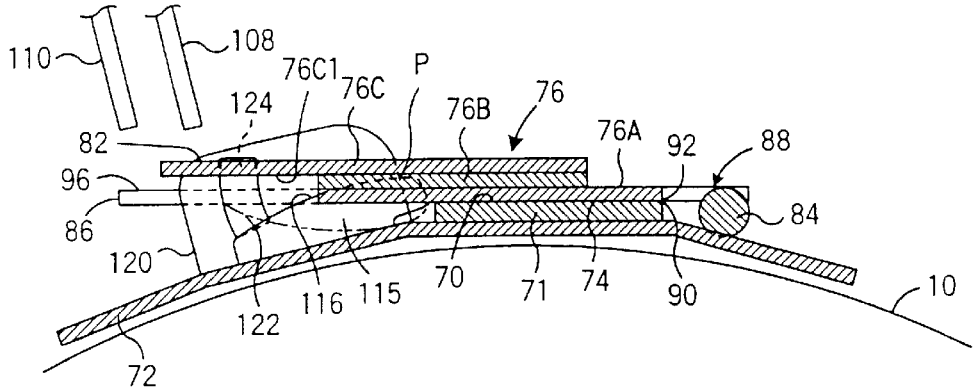
FIGS. 11–13 are diagrammatic side views similar to FIGS. 3*a*–3*h,* showing further detailed constructions of the stencil leading end mounting device according to the present invention.
Figure 13:
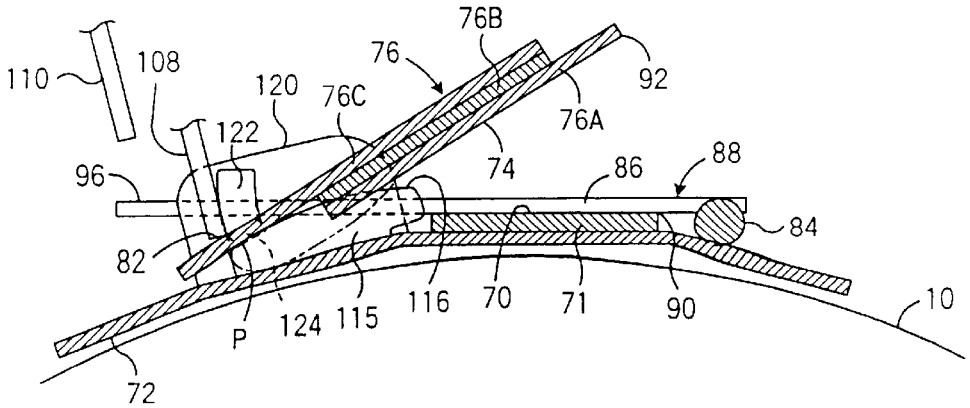

A leftside end portion 82 of one of the bearing portions provided by one of the plate members 76C closer to the actuation means composed of the pulse motor 98, cams 102 and 104 and lever members 108 and 110 operates as the drive portion to be biased downward toward the based member 72 by the lever member 108 for tilting the clamp member 76 from the closed position shown in FIG. 11 to the open position shown in FIG. 13. The end portion 82 corresponds to the lever portion 82 of the prior art shown in FIG. 2.

Below the pair of bearing surfaces 76C1 there are provided a pair of convex cams 115 each having a cam surface 116 facing toward the corresponding bearing surface 76C1, so that the clamp member 76 is seated on the pair of cams 115. The pair of plate members 76C have each a side integral projection 124, while a pair of guide walls 120 are provided adjacent opposite outsides of the cams 115, so as each to present a vertically extending arcuate guide groove 122 into which each corresponding one of the projections 124 is received to be guided thereby. By such an arrangement, the clamp member 76 rolls on the pair of convex cams 115 at its opposite end portions provided by the plate members 76C, with its bearing surfaces 76C1 being in a rolling contact with the cam surfaces 116 not to cause any slip therebetween along the cam surfaces.

Figure 12:
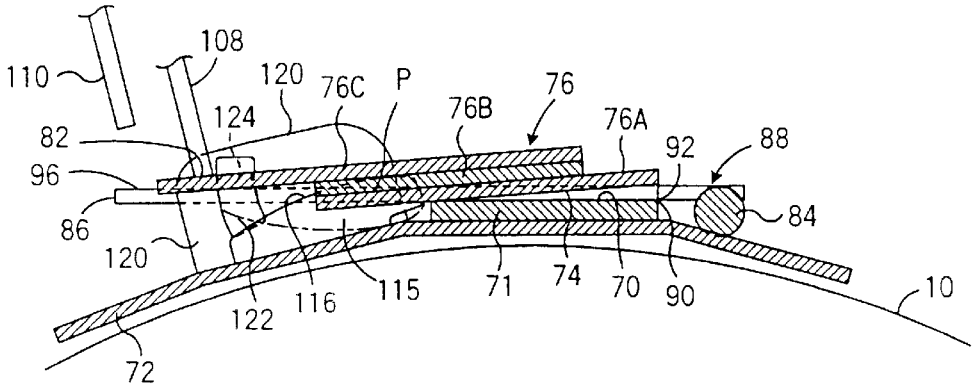

Since the cam surfaces 116 are each convex as seen in FIGS. 11–13, when the clamp member 76 is in the closed position as shown in FIG. 11, a pair of contact points P between the bearing surfaces 76C1 and the cam surfaces 116 are located at an utmost right side of the cam surfaces as viewed in FIGS. 11–13, so as to provide a linear pivot axis at a position connecting those pair of contact points, while when the clamp member 76 is tilted to be more opened against the stencil leading end supporting surface 70 provided by a magnet sheet 71 through the position shown in FIG. 12 to the position shown in FIG. 13, the contact points P shift leftward in these figures as shown therein, thereby providing the linear pivot axis for the tilting of the clamp member 76 relative to the base member 72 in such a manner that the linear pivot axis is shifted from the side of the stencil clamping surface 74 toward the side of the drive portion provided by the end portion 82 of the plate member 76C.

In this connection, it will be noted that, as shown by phantom lines, similar convex cam surfaces such as the cam surfaces 116 may be provided along the lower surfaces of the pair of plate members 76C, so that the clamp member 76 tilts by rolling on the base member 72 with such convex cam surfaces, whereby contacts points similar to the points P defining a similar linear pivot axis for the clamp member 76 is shifted from the side of the stencil clamping surface 74 toward the side of the drive portion provided by the end portion 82 of the plate member 76C when the clamp member 76 is more opened from the closed position. Such an alternative construction is substantially in symmetry to the illustrated construction and operates in the same principle.

When the linear pivot axis is located at such an advanced position as shown by point P in FIG. 11, the force magnifying lever ratio provided by the clamp opening construction for opening the clamp member 76 from the closed position toward the open position by biasing the end portion 82 of the plate member 76C by the lever member 108 is at a relatively high value, so as to apply a relatively strong clamp opening force at a relatively low force application speed according to a constant biasing movement of the lever member 108. Therefore, the clamp member 76 is smoothly detached from the stencil leading end supporting surface 70 against the strongest magnetic attraction force acting thereto according to the principle of reverse proportion of the square of the inter distance.

When the biasing of the end portion 82 of the plate member 76C by the lever member 108 proceeds so as to more remove the clamp portion 76A and 76B from the magnet sheet 71, the magnetic attraction force acting to the clamp portion rapidly lowers against the same biasing force applied by the lever member 108. However, since the linear pivot axis by points P shifts swiftly toward the lever member 108 according to the progress of the removal of the clamp portion 76A and 76B from the magnet sheet 71, so that the force magnifying lever ratio is correspondingly decreased, no overshooting of the opening movement of the clamp member will occur. Further, since the displacement magnifying lever ratio of the clamp opening construction increases inversely to the decrease of the force magnifying lever ratio according to the shifting of the linear pivot axis toward the lever member 108, in the final stage of the opening the clamp member 76 is widely opened as shown in FIG. 13 even when the stroke of the lever member 108 is relatively restricted.

Figure 10:
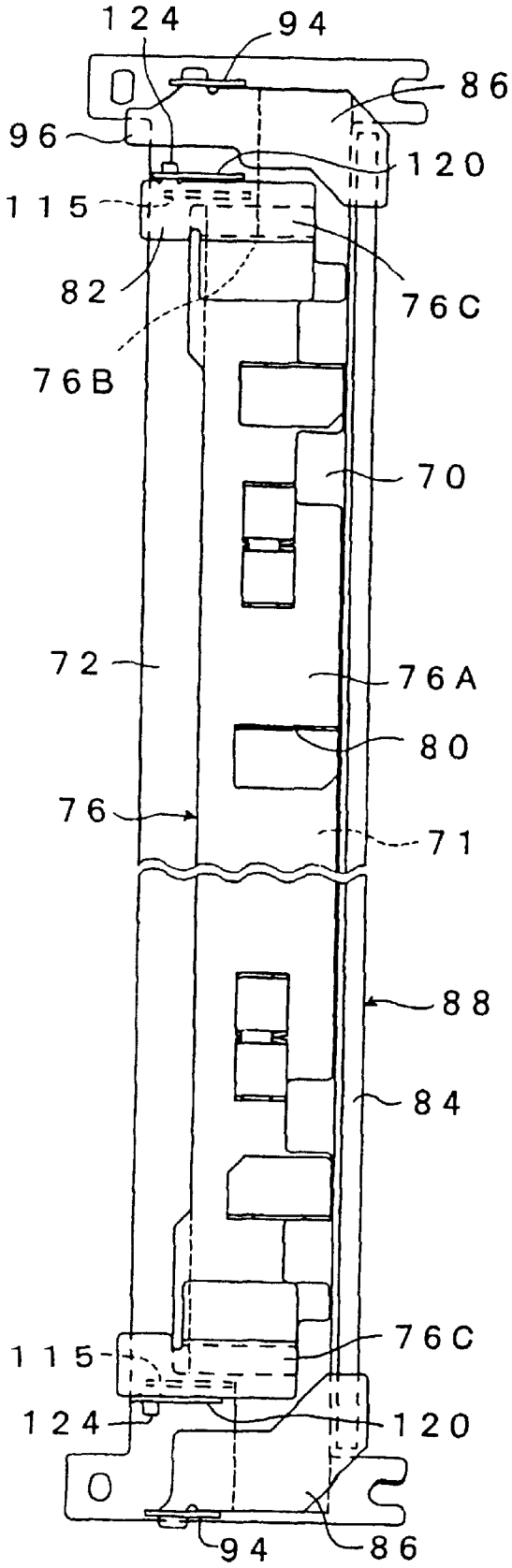
FIG. 10 is a plan view of the stencil leading end mounting device (omitting the actuation means) of the embodiment shown in FIGS. 4–9.
Figure 14:
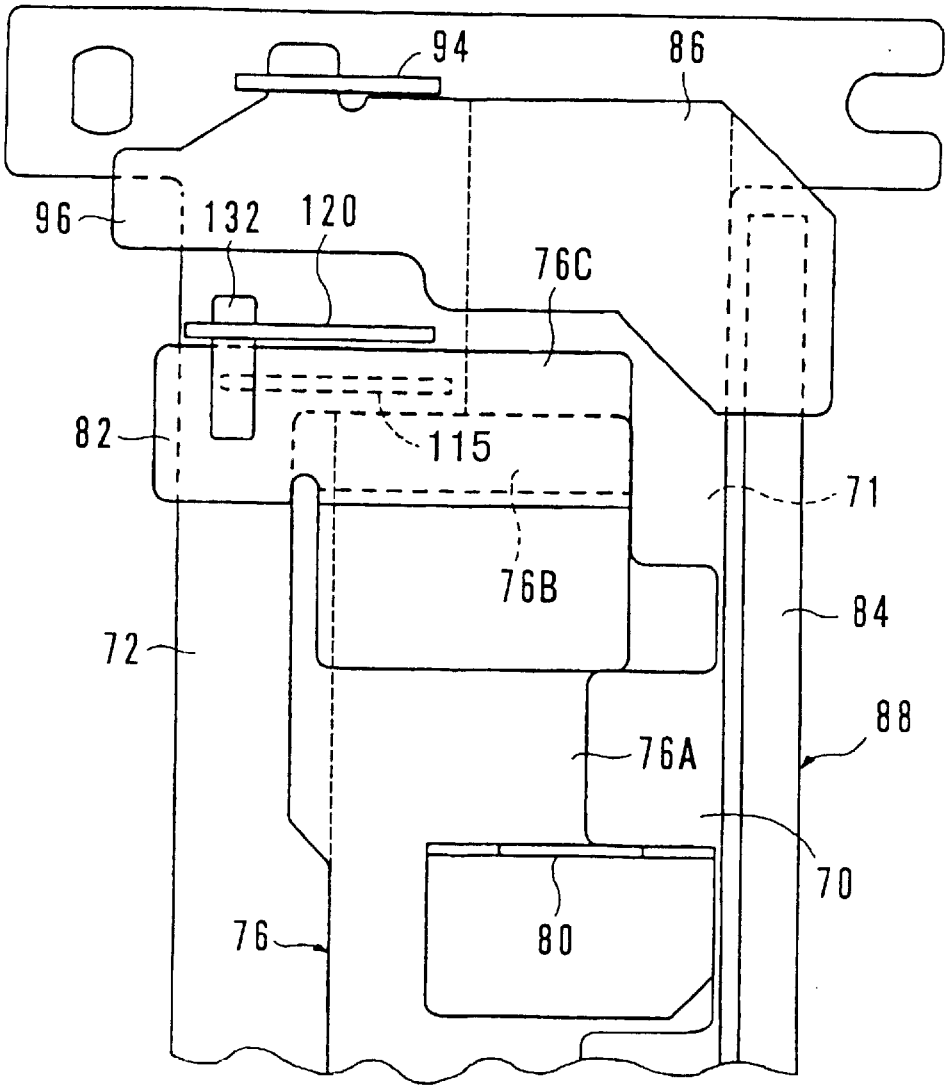
FIG. 14 is a partial plan view showing a modification of a part of the construction of the stencil leading end clamping device shown in FIG. 10.
Figure 15:
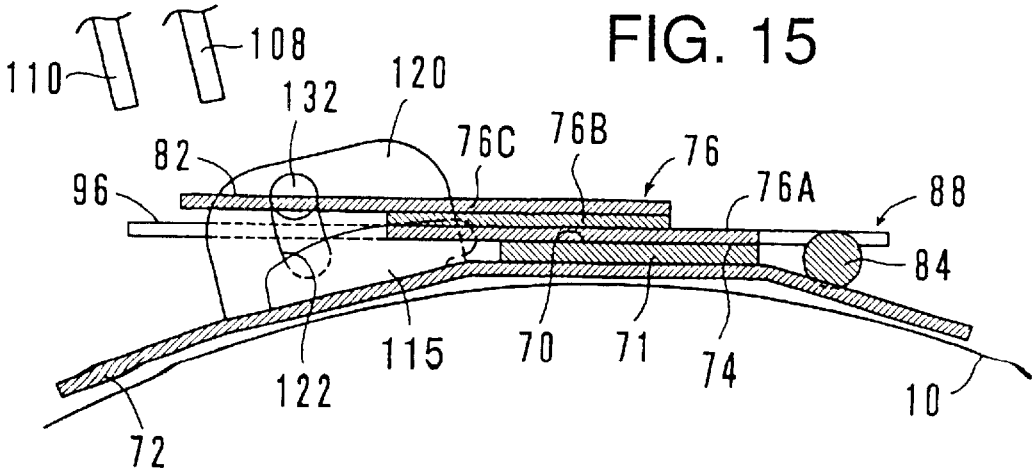
FIG. 15 is a diagrammatic side view similar to FIGS. 11–13, showing the modification of FIG. 14.

FIG. 14 is a partial plan view corresponding to the upper end portion of FIG. 10 in a somewhat larger scale, showing a small modification of a part of the construction shown in FIG. 10, while FIG. 15 is a diagrammatic side view similar to FIGS. 11–13 of the construction shown in FIG. 14. In these figures, the portions corresponding to those shown in FIGS. 10–13 are designated by the same reference numerals and operate in the same manner. In this modification, the integral projection 124 in the embodiment shown in FIGS. 10–13 is replaced by a pin projection 132 attached to the drive portion 82 formed by one end portion of the plate member 76C, while the opposite ends of the guide groove 122 is rounded to coincide with the rounded outside shape of the pin 132.

Figure 16:
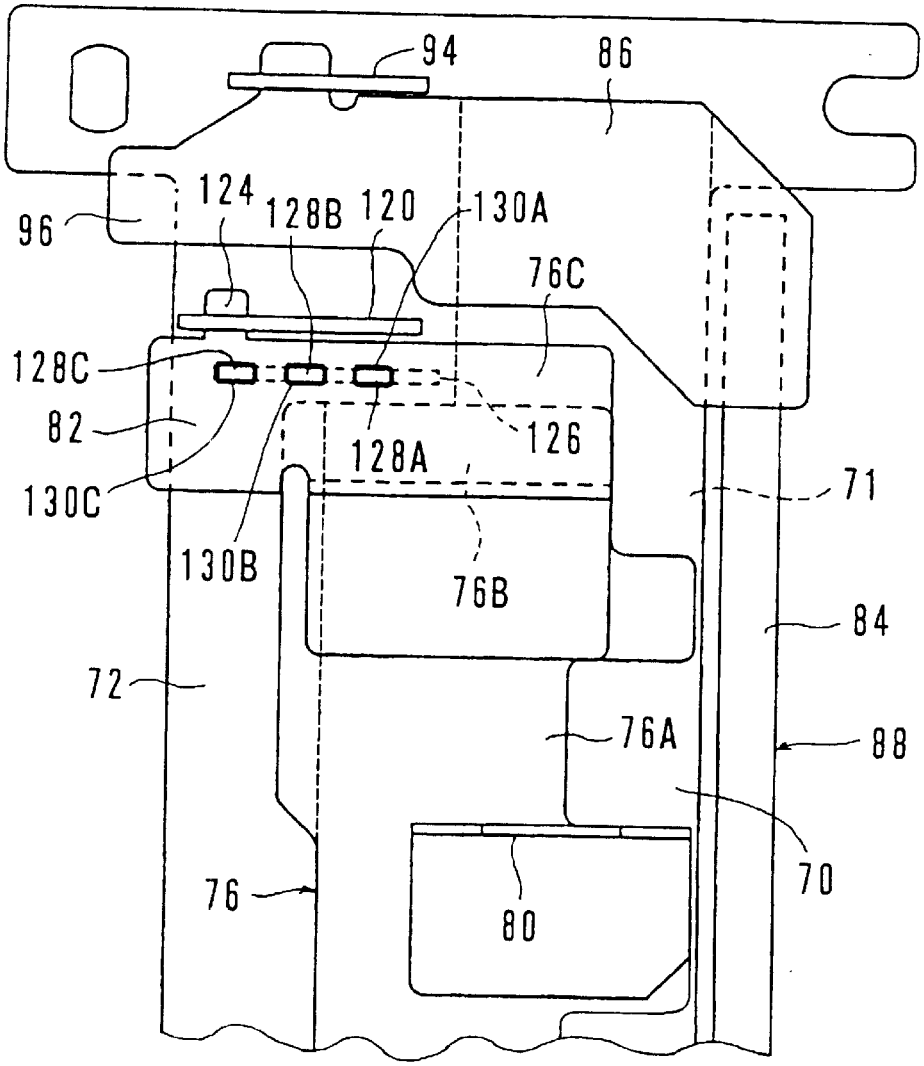
FIG. 16 is a partial plan view shown another modification of a part of the construction of the stencil leading end clamping device shown in FIG. 10.
Figure 17:
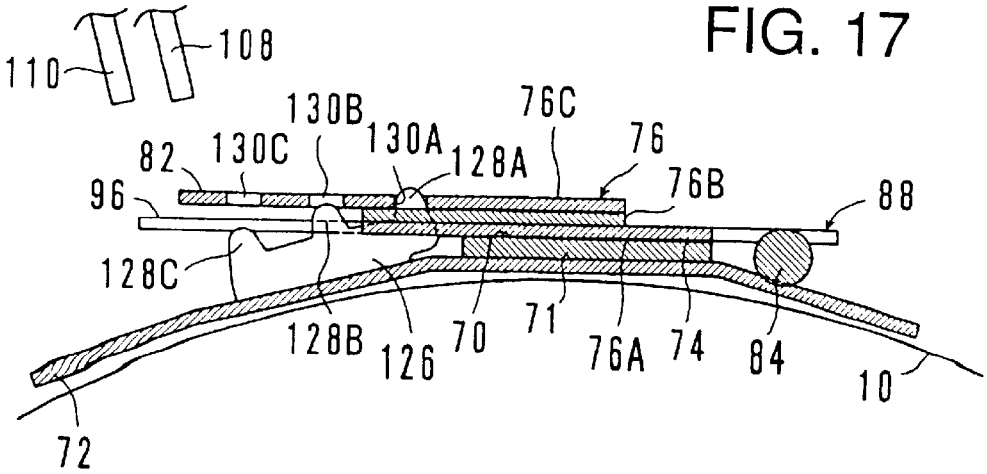
FIG. 17 is a diagrammatic side view similar to FIGS. 11–13, showing the modification of FIG. 16.

FIGS. 16 and 17 are views similar to FIGS. 14 and 15, respectively, showing another embodiment with respect to the cam 115 and the slip stopper construction provided by the integral or pin projection 124 or 132 and the guide groove 122 in the embodiment or its modification shown in the preceding figures. In FIGS. 16 and 17, the portions corresponding to those shown in FIGS. 14 and 15 are designated by the same reference numerals and operate in the same manner. In this embodiment, a cam member 126 corresponding to the preceding cam 115 is formed with a plurality of (indeed three in the shown embodiment) projections 128A, 128B and 128C along its cam surface, while the plate member 76C providing the bearing surface is formed with a plurality of holes 130A, 130B and 130C adapted to engage with the corresponding projections 128A, 128B and 128C. By such an arrangement, it is also effectively prevented that there occurs a relative slipping between the cam 126 and the plate member 76C along the cam surface.

In this connection, it will also be noted that the provision of the plurality of projections 128A, 128B and 128C in the cam member 126 and the corresponding plurality of holes 130A, 130B and 130C in the plate member 76C may be reversed such that the plate member 76C is provided with a plurality of projections similar to the projections 128A, 128B and 128C, while the cam member 126 is formed with a plurality of corresponding grooves similar to the plurality of holes 130A, 130B and 130C for receiving the projections of the plate member 79C. It will be apparent that such an alternative construction operates in the substantially same manner so as to restrict a relative slipping between the cam member 126 and the plate member 76C along the cam surface. Therefore, no further illustration will be required for the full disclosure of the invention in this regard.

Although the present invention has been described in detail with respect to some preferred embodiments thereof, it will be apparent for those skilled in the art that the present invention is not limited to the shown embodiments and other various embodiments are possible based upon the technical concept of the present invention.

What is claimed is:

1. A stencil leading end mounting device of a printing drum of a rotary stencil printer, comprising:

a base member having a stencil leading end supporting surface incorporating a magnet therein, the stencil leading end supporting surface extending along a generatrix of the printing drum for receiving thereon a leading end of a stencil to be mounted around the printing drum;

a clamp member having a clamp portion formed with a stencil clamping surface and a drive portion opposite to the clamp portion, the clamp member being supported on the base member to be tiltable relative to the stencil leading end supporting surface between a closed position in which the clamp portion is laid over the stencil leading end supporting surface so as to clamp the stencil leading end between the stencil leading end supporting surface and the stencil clamping surface under a magnetic attraction of the clamp portion by the magnet toward the stencil leading end supporting surface and an open position in which the stencil clamping surface is inclined apart relative to the stencil leading end supporting surface so as to expose an inter space therebetween for entrance thereto and removal therefrom of the stencil leading end;

pivot means for providing a linear pivot axis between the base member and the clamp member for the clamp member to tilt thereabout between the closed position and the open position with the linear pivot axis being positioned between the clamp portion and the drive portion of the clamp member; and actuation means for selectively biasing the drive portion of the clamp member for tilting the clamp member from the closed position to the open position, wherein the pivot means provide the linear pivot axis so as to move relative to the clamp member from a side of the clamp portion to a side of the drive portion according to a progress of tilting of the clamp member away from the closed position toward the open position.

2. A stencil leading end mounting device according to claim 1, wherein the clamp member includes one of a pair of bearing surfaces and a pair of convex cams along opposite end portions of the stencil clamping surface thereof corresponding to opposite axial ends of the printing drum, while the base member has the other of the pair of bearing surfaces and the pair of convex cams for supporting the one of the pair of bearing surfaces and convex cams on the clamp member, such that each cam surface of the pair of convex cams contacts with each of the pair of bearing surfaces at a point which moves along the cam surface from the clamp portion side to the drive portion side according to the progress of tilting of the clamp member away from the closed position.

3. A stencil mounting device according to claim 2, wherein the pivot means further comprise means for restricting a slipping of the bearing surfaces relative to the cam surfaces therealong.

4. A stencil mounting device according to claim 3, wherein the slip restriction means comprise a pair of guide grooves provided on the base member adjacent the pair of cams to extend substantially perpendicularly relative to a direction of extension of each cam surface and a pair of projections provided on the clamp member so as to engage in the guide grooves.

5. A stencil mounting device according to claim 4, wherein the pair of guide grooves are each arcuate to follow a contour of movement of each of the projections relative to each of the guide grooves due to a rolling of the clamp member on the cams.

6. A stencil mounting device according to claim 3, wherein the slip restriction means comprise a plurality of projections formed along the cam surfaces, and a corresponding plurality of openings formed in the bearing surfaces so as to engage with the projections according to a rolling of the bearing surfaces on the cam surfaces.

* * * * *